US012150555B2

(12) United States Patent
Shaw

(10) Patent No.: US 12,150,555 B2
(45) Date of Patent: Nov. 26, 2024

(54) COMPACT FOLDING COT WITH TELESCOPIC FEATURES

(71) Applicant: Ryan C. Shaw, Greensburg, PA (US)

(72) Inventor: Ryan C. Shaw, Greensburg, PA (US)

( * ) Notice: Subject to any disclaimer, the term of this patent is extended or adjusted under 35 U.S.C. 154(b) by 201 days.

(21) Appl. No.: 18/147,742

(22) Filed: Dec. 29, 2022

(65) Prior Publication Data

US 2023/0263310 A1 Aug. 24, 2023

Related U.S. Application Data

(60) Provisional application No. 63/311,998, filed on Feb. 19, 2022.

(51) Int. Cl.

| | |
|---|---|
| ***A47C 17/72*** | (2006.01) |
| ***A47C 17/64*** | (2006.01) |
| ***A47C 17/70*** | (2006.01) |
| ***A47C 17/76*** | (2006.01) |

(52) U.S. Cl.

CPC ..... *A47C 17/72* (2013.01); *A47C 17/70* (2013.01); *A47C 17/76* (2013.01); *A47C 17/64* (2013.01)

(58) Field of Classification Search

CPC ..... A47C 17/72; A47C 17/76; A47C 17/70; A47C 17/74; A47C 17/64; A47C 17/645; A47C 17/86

USPC ..... 5/114, 112, 115–117, 110, 111

See application file for complete search history.

(56) References Cited

U.S. PATENT DOCUMENTS

| | | | | |
|---|---|---|---|---|
| 813,521 | A * | 2/1906 | Reilly | A47C 19/126 5/93.1 |
| 1,209,679 | A * | 12/1916 | Decker | A47C 19/126 108/118 |
| 6,553,586 | B1 * | 4/2003 | Lin | A47C 17/64 5/117 |
| 7,661,159 | B1 * | 2/2010 | Chen | A47C 17/72 5/116 |
| 7,698,756 | B1 * | 4/2010 | Chen | A47C 17/72 135/96 |
| 8,499,380 | B2 | 8/2013 | Grace | |
| 8,528,131 | B2 | 9/2013 | Sun | |
| 8,806,675 | B2 | 8/2014 | Lah | |
| 9,131,778 | B2 * | 9/2015 | Jin | A47C 17/72 |
| 9,848,710 | B2 * | 12/2017 | Choi | A47C 17/72 |
| 10,820,712 | B2 * | 11/2020 | Huang | A47C 19/02 |
| 11,116,323 | B2 * | 9/2021 | Wang | A47C 17/70 |
| 2011/0308012 | A1 * | 12/2011 | Jin | A47C 17/70 5/110 |
| 2012/0047649 | A1 * | 3/2012 | Grace | A47C 17/64 5/115 |
| 2012/0317717 | A1 * | 12/2012 | Jin | A47C 17/72 5/110 |

(Continued)

*Primary Examiner* — Robert G Santos

(74) *Attorney, Agent, or Firm* — The Webb Law Firm

(57) ABSTRACT

A cot assembly includes a plurality of bed rail members, and a plurality of leg assemblies each connected to the plurality of bed rail members. Each of the plurality of leg assemblies includes a pair of upper leg members, a pair of lower leg members each pivotally connected to one of the upper leg members, a cross-hinge assembly connected to the upper leg members, and a pair of extension arm members each pivotally connected to the cross-hinge assembly and to one of the lower leg members. The cross-hinge assembly includes a slot and a pin configured to slide within the slot so to lock each leg assembly, and the cot assembly as a whole, in a deployed position.

16 Claims, 9 Drawing Sheets

(56) References Cited

U.S. PATENT DOCUMENTS

| | | | | |
|---|---|---|---|---|
| 2015/0089737 | A1* | 4/2015 | Ling | A47C 17/72<br>5/111 |
| 2017/0295940 | A1* | 10/2017 | Choi | A47C 17/70 |
| 2019/0167009 | A1* | 6/2019 | Huang | A47C 19/14 |
| 2020/0315361 | A1* | 10/2020 | Wang | A47C 19/14 |
| 2023/0263310 | A1* | 8/2023 | Shaw | A47C 17/76<br>5/114 |

* cited by examiner

W

COMPACT FOLDING COT WITH TELESCOPIC FEATURES

CROSS-REFERENCE TO RELATED APPLICATION

The present application claims the benefit of U.S. Provisional Patent Application No. 63/311,998, filed Feb. 19, 2022, the disclosure of which is hereby incorporated by reference in its entirety.

BACKGROUND

Field

The present invention relates to collapsible furniture and more specifically, to a collapsible and portable cot assembly.

Description of Related Art

The cot is a device that has been used for well over a century for both military and recreational camping applications. The purpose of a cot is to elevate an individual off the ground when they sleep. This keeps an individual's body temperature cooler and helps to remove the individual from ground moisture and insects.

There currently exist many different cot designs on the market; however many of these designs are dated and have remained unchanged and unimproved upon since their introduction.

The design of the U.S. government's standard issue cot, the M-1938 cot, more commonly referred to as the "military cot", has remained practically unchanged since its adoption by the U.S. military in 1938. The only change made to this cot during its extensive service life is a change in the material of the cot's structural members from solid wood members to hollow aluminum members. While swapping out the wood members for aluminum members reduced the weight of the cot, the cot is still quite bulky and cumbersome in its collapsed form making it a nuisance to carry and a hindrance to supply chain efficiency. Additionally, the average soldier of today is larger than the average soldier in 1938 and so while the M-1938 cot may have had a large enough sleeping surface for soldiers when first introduced, today the size of its sleeping surface is dated and less accommodating. Hence, for military applications, there exists a need for a new cot that has a large enough sleeping surface when deployed to accommodate the modern soldier and yet is more compact when collapsed to aid in supply chain efficiency.

Most recreational camping cot designs are largely based off, or are exact copies, of the M-1938 cot design and so these designs suffer from the same flaws as the M-1938 cot, that being a lack of compactness when folded and too small of a sleeping surface. A lack of compactness makes most recreational camping cots difficult for the average camper to carry and space consuming when packing along with other camping gear in the back of a vehicle. As it pertains to the sleeping surface being too small, just as the average soldier has grown overtime, so too has the average camper and so the recreational camping cot can be made larger to be more accommodating of larger and/or taller body types.

Presently, there exists a need for a cot having a larger sleeping surface and that is more compact when folded, while also being relatively easy to set-up or collapse. Such a design would make recreational camping more enjoyable and, if adopted by the U.S. government, would improve the efficiency of their military and disaster relief supply chains.

SUMMARY OF THE INVENTION

In view of the foregoing, the present disclosure is directed to cot assemblies that offer a large sleeping surface, are compact when folded, and are easy to fold and deploy. Embodiments of the present disclosure are directed to a cot assembly including a plurality of bed rail members, and a plurality of leg assemblies each connected to the plurality of bed rail members. Each of the plurality of leg assemblies includes a pair of upper leg members, a pair of lower leg members each pivotally connected to one of the upper leg members, a cross-hinge assembly connected to the upper leg members, and a pair of extension arm members each pivotally connected to the cross-hinge assembly and to one of the lower leg members. The cross-hinge assembly includes a slot and a pin configured to slide within the slot to deploy the leg assembly.

In some embodiments, the slot includes a straight portion and a curved portion, the pin is in the straight portion of the slot with the leg assembly in a deployed position, and the pin is in the curved portion of the slot with the leg assembly pivoting between the deployed position and a collapsed position.

In some embodiments, the cross-hinge assembly includes a pair of hooks configured to retain the pin in the straight portion of the slot in the deployed position so to lock the cot in the deployed position.

In some embodiments, the cross-hinge assembly includes a spring configured to pull the pin to a bottom of the straight portion of the slot.

In some embodiments, the plurality of leg assemblies are pivotally connected to the plurality of bed rail members.

In some embodiments, the plurality of bed rail members includes telescoping bed rail members.

In some embodiments, the cot assembly further includes a button for collapsing the telescoping bed rail members.

In some embodiments, the plurality of leg assemblies includes two exterior leg assemblies.

In some embodiments, the exterior leg assemblies are pivotable relative to the plurality of bed rail members.

In some embodiments, the exterior leg assemblies are connected to the plurality of bed rail members via one or more hinge plates.

In some embodiments, the plurality of leg assemblies includes one interior leg assembly.

In some embodiments, the plurality of bed rail members are pivotable relative to the interior leg assembly.

In some embodiments, the interior leg assembly is connected to the plurality of bed rail members via one or more hinge plates.

In some embodiments, the cot assembly further includes a fabric web connected to the plurality of bed rail members.

In some embodiments, the cross-hinge assembly is X-shaped.

In some embodiments, each of the lower leg members are connected to corresponding upper leg members via one or more L-shaped hinge plates.

Further details and advantages of the various examples described in detail herein will become clear upon reviewing the following detailed description of the various examples in conjunction with the accompanying drawing figures.

BRIEF DESCRIPTION OF THE DRAWINGS

Some embodiments of the present disclosure are illustrated as an example and are not limited by the figures of the accompanying drawings, in which like references may indicate similar elements and in which.

DETAILED DESCRIPTION OF THE INVENTION

Figure 1:
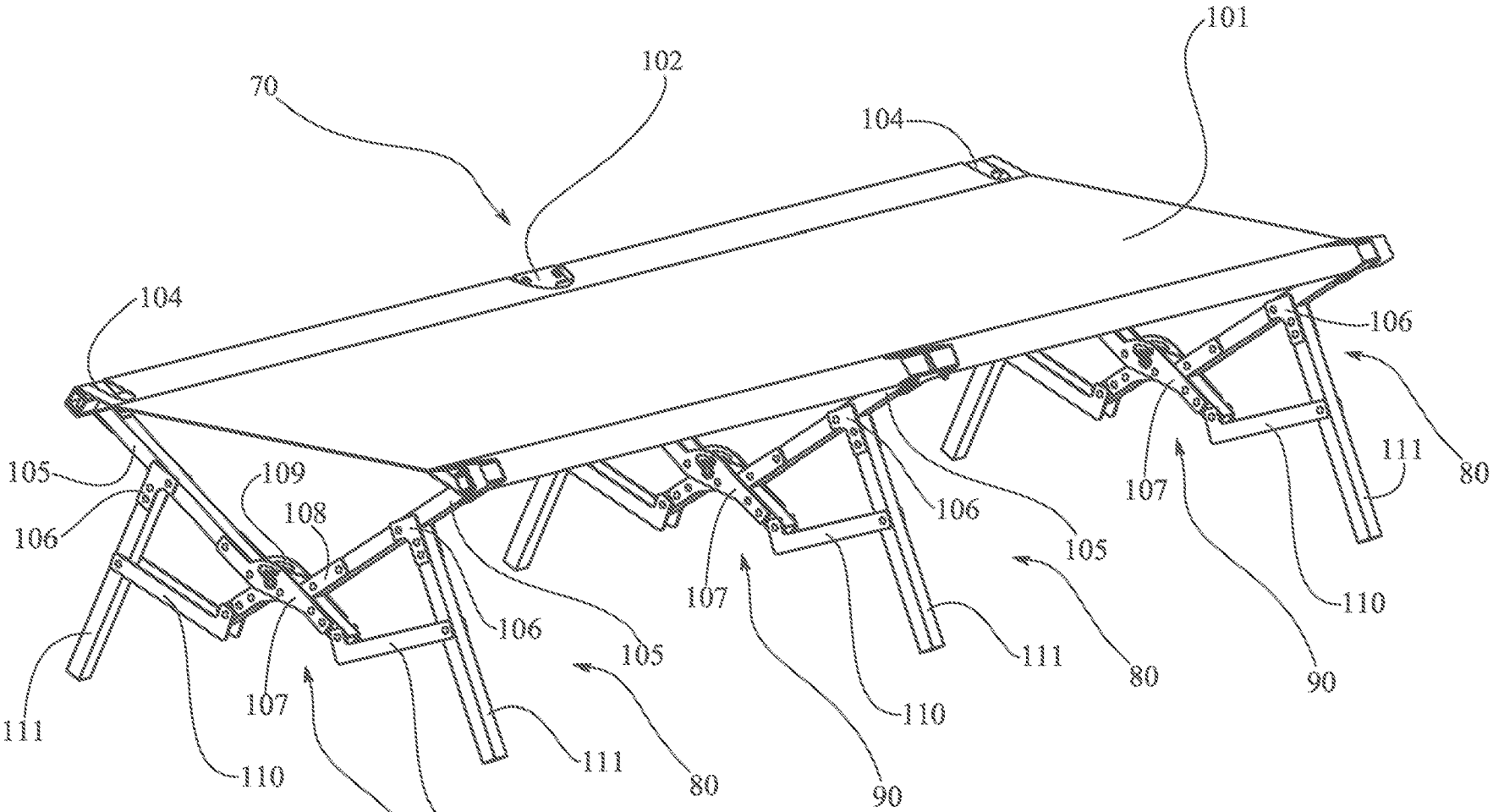
FIG. 1 is an isometric view of the cot assembly in a set up or deployed position.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

For purposes of the description hereinafter, the terms "upper", "lower", "right", "left", "vertical", "horizontal", "top", "bottom", "lateral", "longitudinal", and derivatives thereof shall relate to the disclosure as it is oriented in the drawing figures.

Spatial or directional terms, such as "left", "right", "inner", "outer", "above", "below", and the like, are not to be considered as limiting as the invention can assume various alternative orientations.

All numbers used in the specification and claims are to be understood as being modified in all instances by the term "about". In this context, the terms "approximately", "about", and "substantially" mean a range of plus or minus ten percent of the stated value. Similarly, all angular characterization such as "parallel" and "perpendicular" used in the specification and claims are understood as being modified in all instances by the term "about". In this context, the terms "approximately", "about", and "substantially" mean a range within then degrees of the angular characterization. For example, the term "substantially parallel" means within ten degrees (plus or minus) of being parallel.

As used herein, the term "at least one of" is synonymous with "one or more of". For example, the phrase "at least one of A, B, and C" means any one of A, B, and C, or any combination of any two or more of A, B, and C. For example, "at least one of A, B, and C" includes one or more of A alone; or one or more of B alone; or one or more of C alone; or one or more of A and one or more of B; or one or more of A and one or more of C; or one or more of B and one or more of C; or one or more of all of A, B, and C. Similarly, as used herein, the term "at least two of" is synonymous with "two or more of". For example, the phrase "at least two of D, E, and F" means any combination of any two or more of D, E, and F. For example, "at least two of D, E, and F" includes one or more of D and one or more of E; or one or more of D and one or more of F; or one or more of E and one or more of F; or one or more of all of D, E, and F.

It is also to be understood that the specific devices and processes illustrated in the attached drawings, and described in the following specification, are simply exemplary examples of the disclosure. Hence, specific dimensions and other physical characteristics related to the examples disclosed herein are not to be considered as limiting.

New folding cot devices are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description to follow.

The present disclosure is directed to a novel folding cot design including parallel telescoping rail members, a fabric web, and a plurality of leg assemblies with integrated locking mechanisms. The cot is one piece and requires no assembly or disassembly when setting up or when collapsing. From herein, the shorter side of the cot is defined as its width while the longer side of the cot is defined as its length.

When the cot is set up, the fabric web will support a person sitting or lying on its surface where the fabric web itself is suspended and held taut between two parallel telescoping rail members. The parallel telescoping rail members are supported and spread out to a width to keep the fabric web taut by the leg assemblies and integrated locking mechanisms. The leg assemblies are made up of four individual structural members and the aforementioned integrated locking mechanisms where when the cot is set up, all together form an X-shaped configuration. When collapsing the cot, the integrated locking mechanisms are released allowing the leg assemblies to collapse so that the structural members in each leg assembly are then lying parallel to each another. Simultaneously with the collapsing of the leg assemblies, the parallel telescoping rail members, which are connected to the top of the leg assemblies, will close or move towards each other about the cot's width until they are in abutment. From this state, the two exterior leg assemblies can then be pivoted upwards about the ends of the parallel telescoping rail members until they are resting on top of and are lying substantially parallel to these rail members. The telescoping rail members have four locking buttons, one at either end of each rail member, which are then depressed so that the telescoping rail members can be collapsed along the cot's length, carrying with them the exterior leg assemblies. The collapsed parallel telescoping rail members and exterior leg assemblies can then be pivoted about a hinge plate at the midpoint of each parallel telescoping rail member so that they fall to be substantially parallel to the center leg assembly. Similarly, the set-up of the cot is performed in the reverse procedure.

Figure 2:
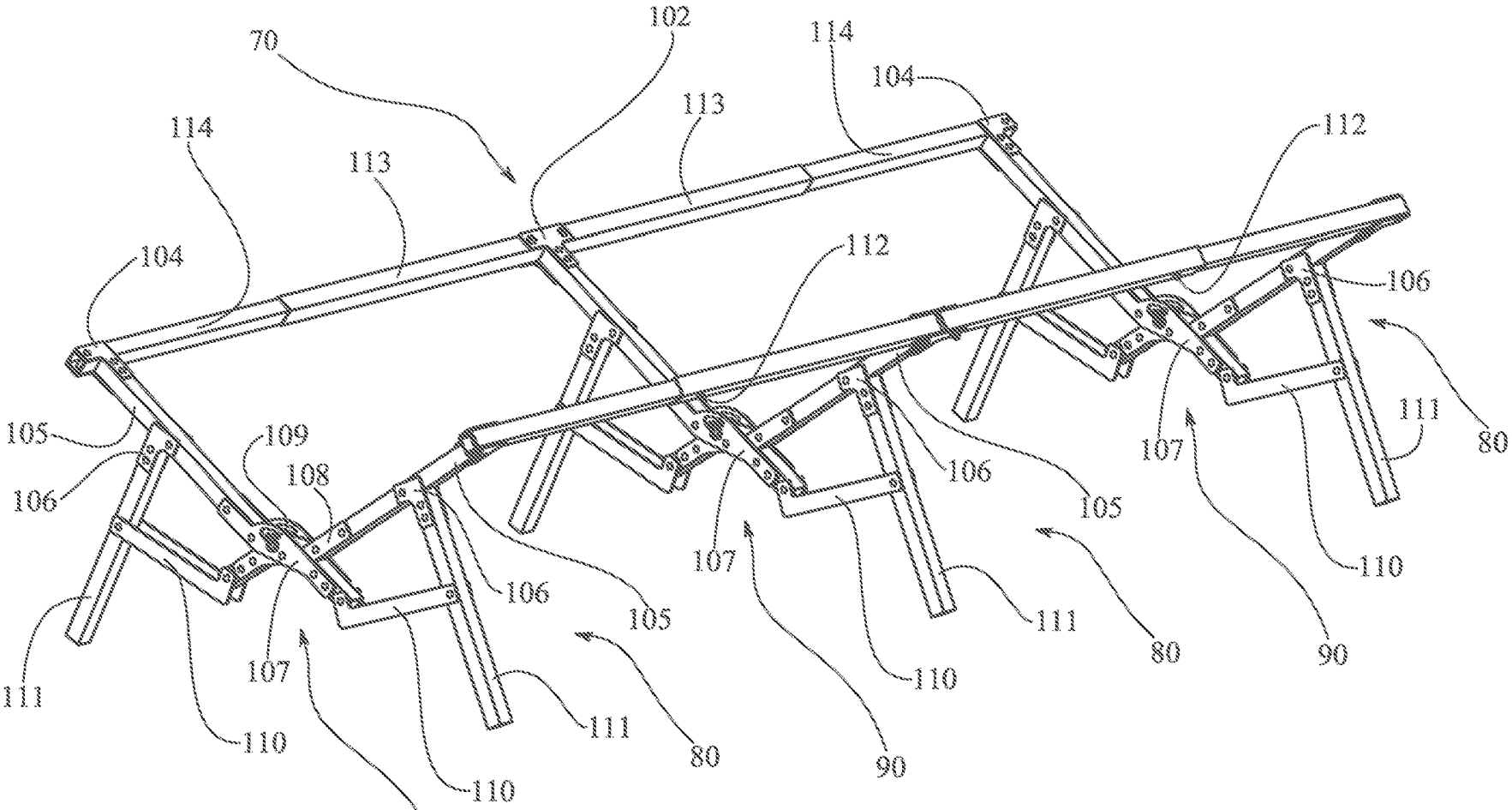
FIG. 2 is an isometric view of the cot assembly of FIG. 1 in a set up or deployed position with the fabric web removed.

A cot assembly 70 in accordance with embodiments of the present disclosure will now be described by referencing the appended figures, in which like reference numerals refer to like components throughout the various views thereof. FIGS. 1 and 2 depict isometric views of the cot assembly 70 in a set up or deployed position. The cot assembly 70 includes a plurality of leg assemblies 80, telescoping bed rail members 113, 114, T-shaped hinge plates 102, L-shaped hinge plates 104, and a fabric web 101. The fabric web 101 is held taught when the cot assembly 70 is locked at a maximum width by the locking pin 109 and a cross-hinge assembly 90 contained within each leg assembly 80. Each leg assembly 80 includes two upper leg members 105, two lower leg members 111, L-shaped hinge plates 104, L-shaped hinge plates 106, extension arm members 110, and a cross-hinge assembly 90. The upper leg members 105 are rigidly connected to the cross-hinge assembly 90. Each of the lower leg members 111 is pivotally connected to a corresponding upper leg member 105 via the L-shaped hinge plates 106. Each of the extension arm members 110 is pivotally connected at one end to a corresponding lower leg member 111 and at another end to the cross-hinge assembly 90.

The cross-hinge assembly 90 includes two exterior cross-hinge plates 107 with slots 117, two interior cross-hinge plates 108 with hooks 118, a spring 115, and a locking pin 109. The locking pin 109 locks the two individual slotted cross-hinge plates 107 and two individual hooked cross-hinge plates 108 in an X-shaped or crossed position relative to one another which is what forces the leg assemblies 80 into a position where the leg assemblies 80 are deployed to a fullest extent.

FIG. 2 depicts an isometric view of the cot assembly 70 but with the fabric web 101 removed. In FIGS. 2-5D, the fabric web 101 is omitted for illustrative purposes only. In some embodiments, the fabric web 101 remains on the cot assembly 70 through the entire folding procedure of the cot assembly 70. During a normal folding procedure, the fabric web 101 is unattached from each corner of the cot assembly 70 and slid along the telescoping bed rail members 113, 114 from either end until the fabric web 101 is scrunched up against the center leg assembly 80. From this point, the cot assembly 70 can be folded and the fabric web 101 will become bundled within the folded cot assembly 70. When unfolding the cot assembly 70, the reverse of this procedure is performed to resuspend the fabric web 101 across the cot assembly 70.

Figure 3A:
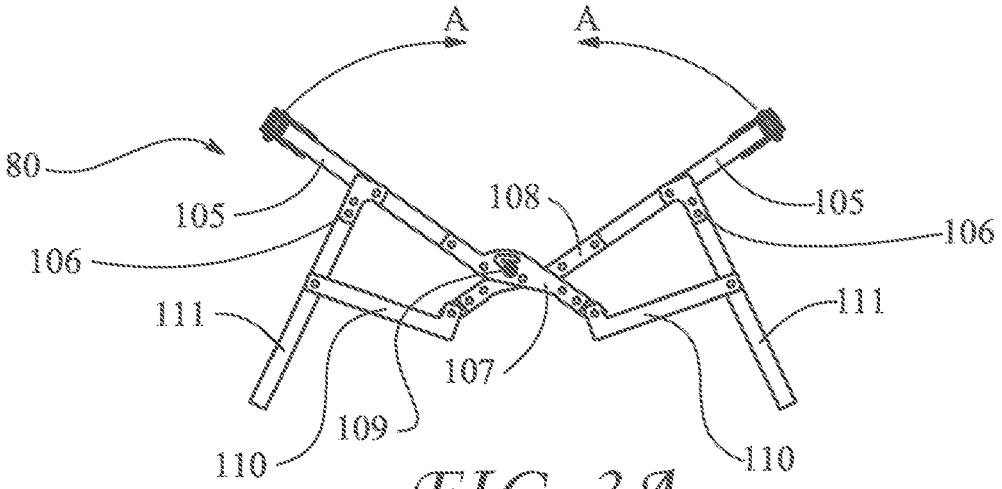
FIG. 3A is a front view of the cot assembly of FIG. 2 in a set up or deployed position.
Figure 3B:
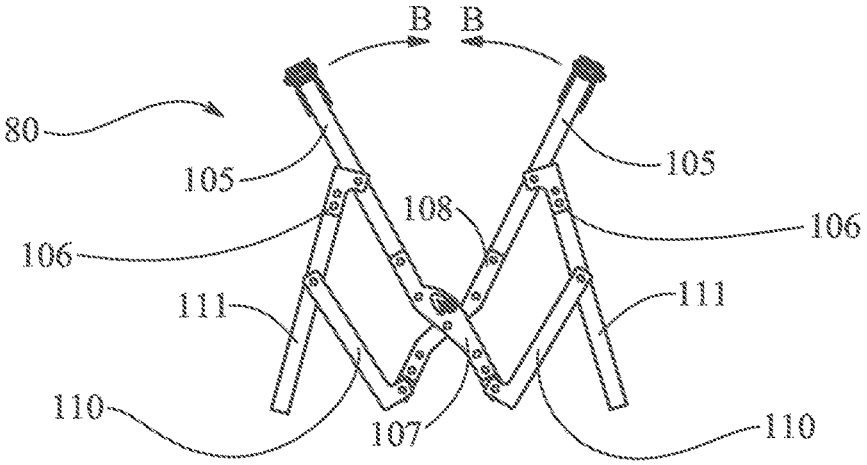
FIG. 3B is a front view of the cot assembly of FIG. 2 while in the process of being collapsed about a width thereof.
Figure 3C:
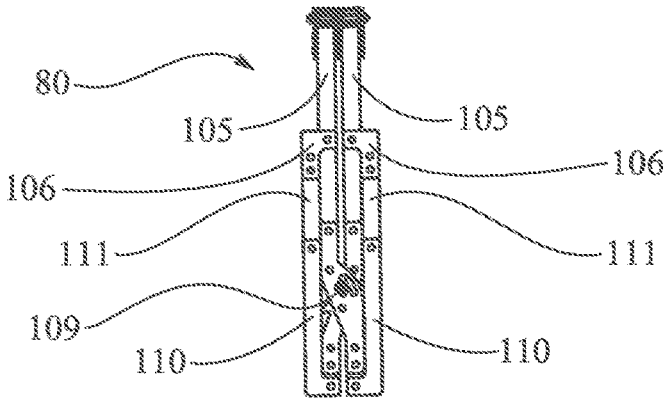
FIG. 3C is a front view of the cot assembly of FIG. 2 when completely collapsed about the width thereof.
Figure 4A:
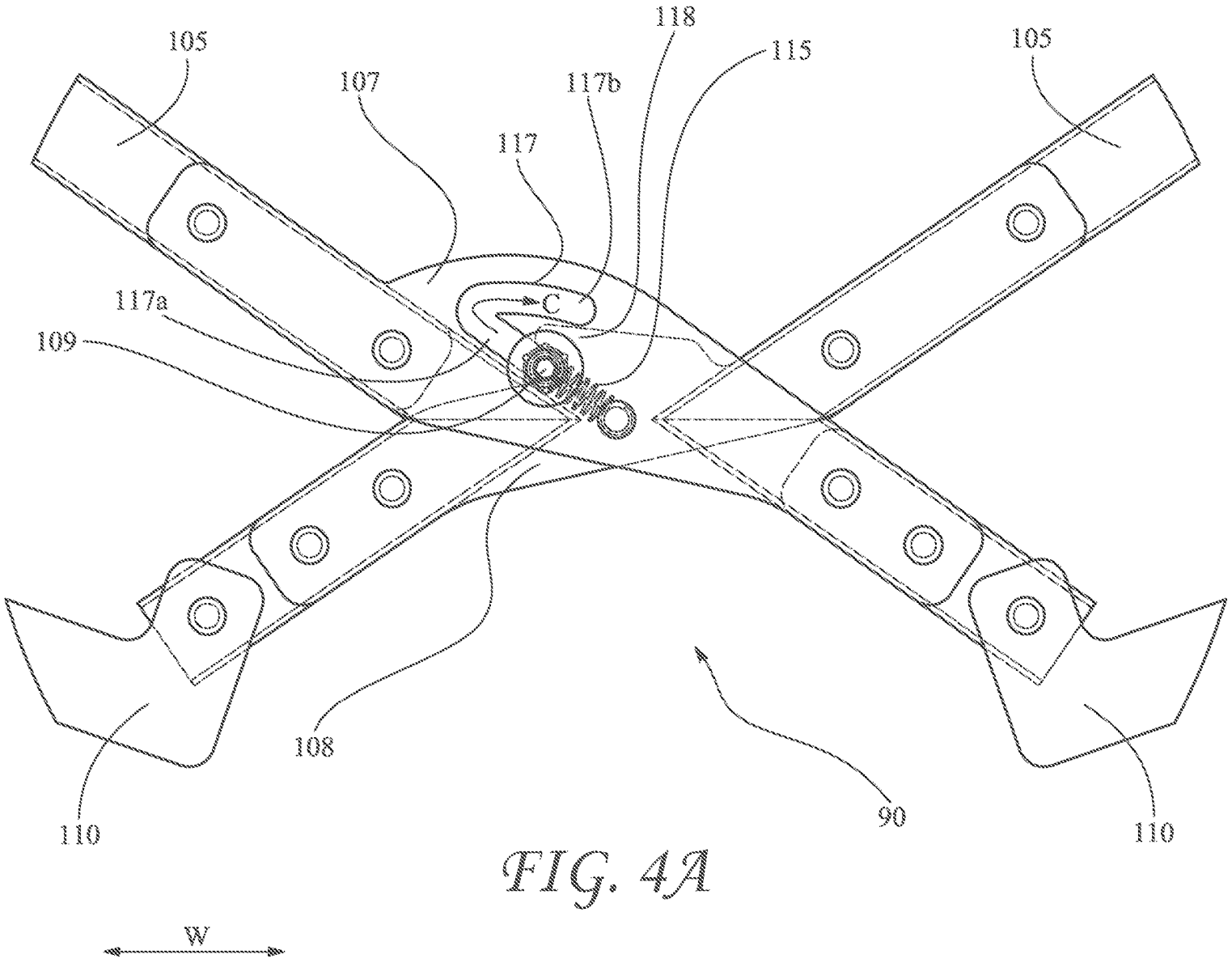
FIG. 4A is a detail view of a cross-hinge assembly and locking pin of FIG. 3A in the set up position.
Figure 4B:
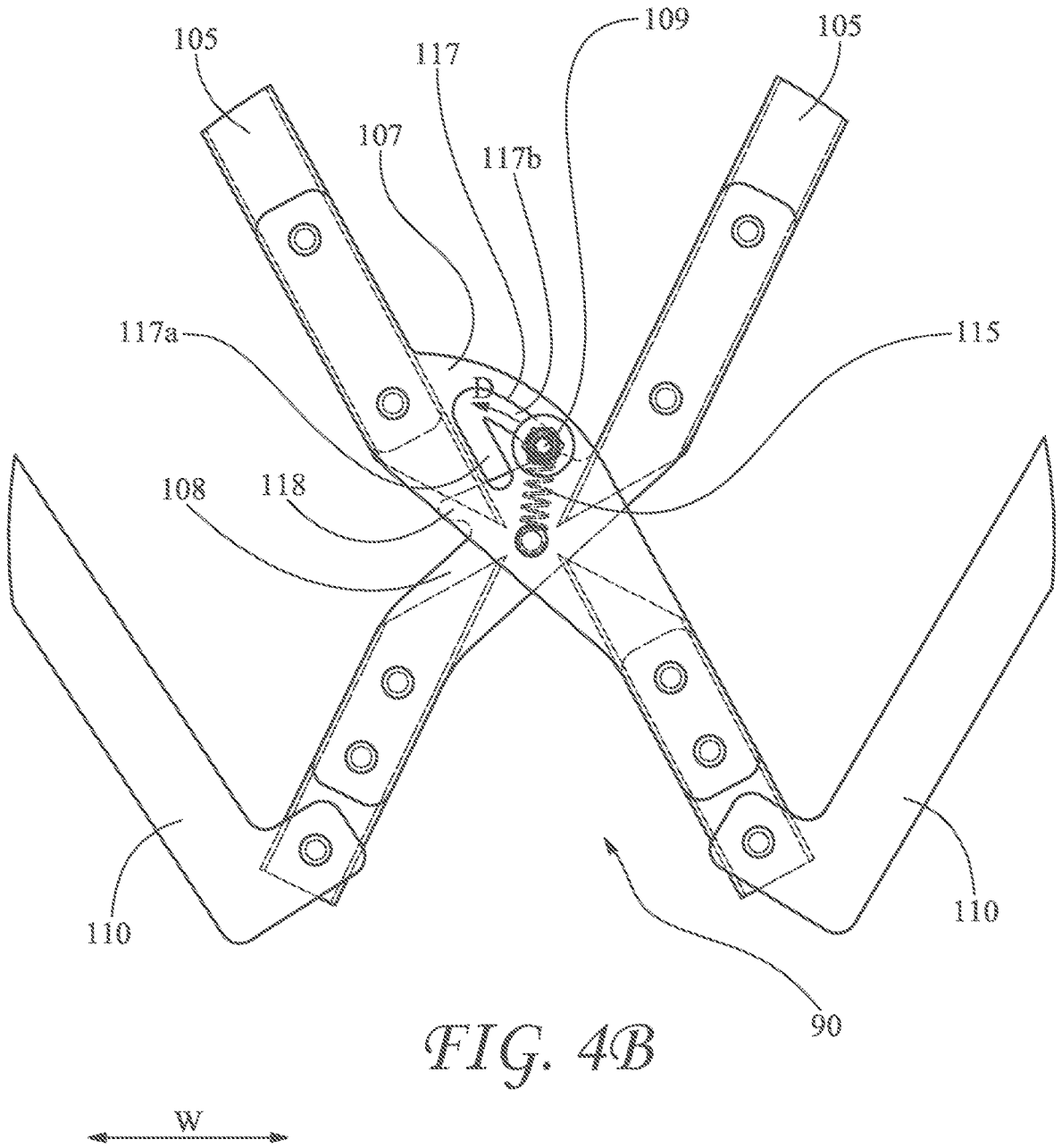
FIG. 4B is a detail view of the cross-hinge assembly and locking pin of FIG. 3B as the cot is in the process of being collapsed about the width thereof.
Figure 4C:
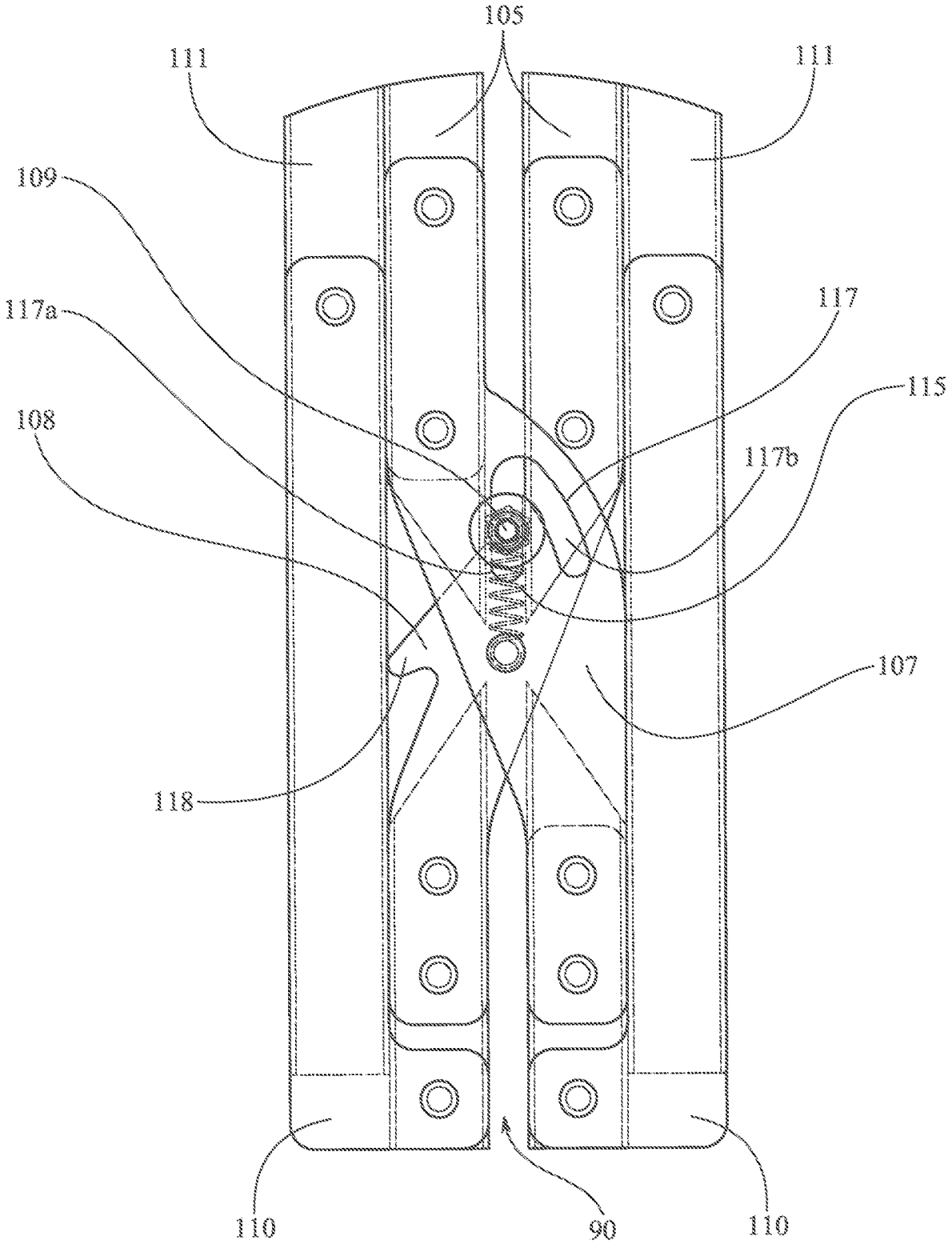
FIG. 4C is a detail view of the cross-hinge assembly and locking pin of FIG. 3C when the cot is completely collapsed about the width thereof.

FIGS. 3A, 3B, and 3C show the cot assembly 70 if viewed from either the base or the head of the cot assembly 70 and demonstrate the action of the leg assemblies 80 as well as the cross-hinge assemblies 90 as the cot assembly 70 is collapsed about a width W of the cot assembly 70. FIGS. 3A, 3B, and 3C are to be worked with FIGS. 4A, 4B, and 4C respectively where FIGS. 4A, 4B, and 4C are detail views of FIGS. 3A, 3B, and 3C focusing on the cross-hinge assembly 90. FIG. 3A and FIG. 4A shows the cot assembly 70, leg assembly 80 and the cross-hinge assembly 90 when in the same state as FIG. 2, or before beginning folding the cot assembly 70. In now referring to FIG. 4A specifically, to begin folding the cot assembly 70, the locking pin 109 must first be moved in the direction of the arrow C or up a straight portion 117*a* of the slot 117 and then to the right into a curved portion 117*b* of the slot 117 cut into the exterior cross-hinge plates 107. This action disengages the locking pin 109 from the hook 118 that is cut into each of the interior cross-hinge plates 108. When the locking pin 109 of each of the leg assembly 80 is in this position, that is positioned within the curved portion 117*b* of the slot 117, the cross-hinge assemblies 90 and leg assemblies 80 are free to pivot and the cot assembly 70 is free to be collapsed about the width W of the cot assembly 70 or along the path of the arrows A. FIG. 3B shows the cot assembly 70 in the process of being collapsed about the width with the arrows B representing this collapsing motion while FIG. 4B shows that as the cot assembly 70 is collapsed about the width W, the locking pin 109 in each cross-hinge assembly 90 is pushed by the interior cross-hinge plates 108 and an upper leg member 105 in the direction denoted by the arrow D or back to the left towards the straight portion 117*a* of the slot 117. FIG. 3C and FIG. 4C show that as the cot 70 reaches a fully collapsed position about the width W, the locking pin 109 settles into a position within and near the top of the straight portion 117*b* of the slot 117. With this positioning of the locking pin 109, the locking pin 109 will be pulled on by the spring 115 as the cot assembly 70 is reopened, directing the locking pin to follow the contour of the interior cross-hinge plates 108 until it reaches a bottom of the straight portion 117*b* of the slot 117 and reengages with the hooks 118 cut into the interior cross-hinge plates 108. At this point, the cot 70 is now locked at its maximum width.

Figure 5A:
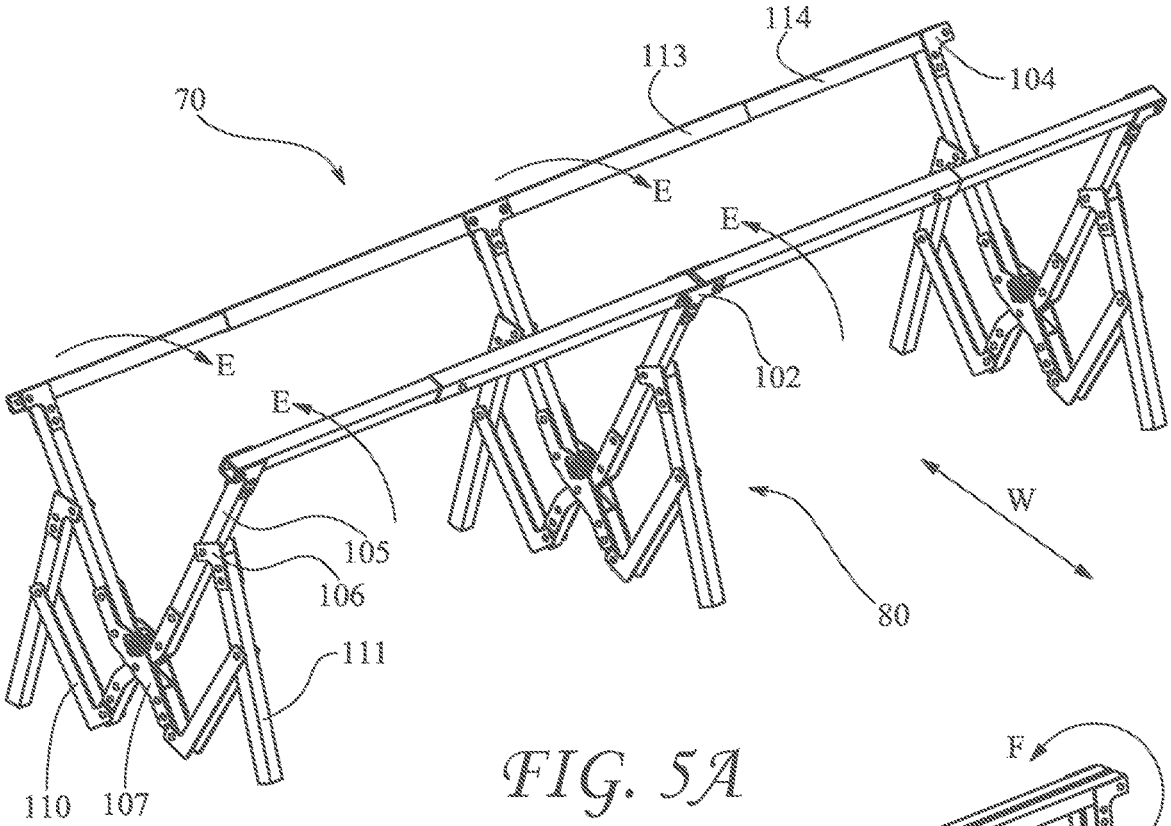
FIG. 5A is an isometric view of the cot assembly of FIG. 2 in the process of being collapsed about the width thereof.
Figure 5B:
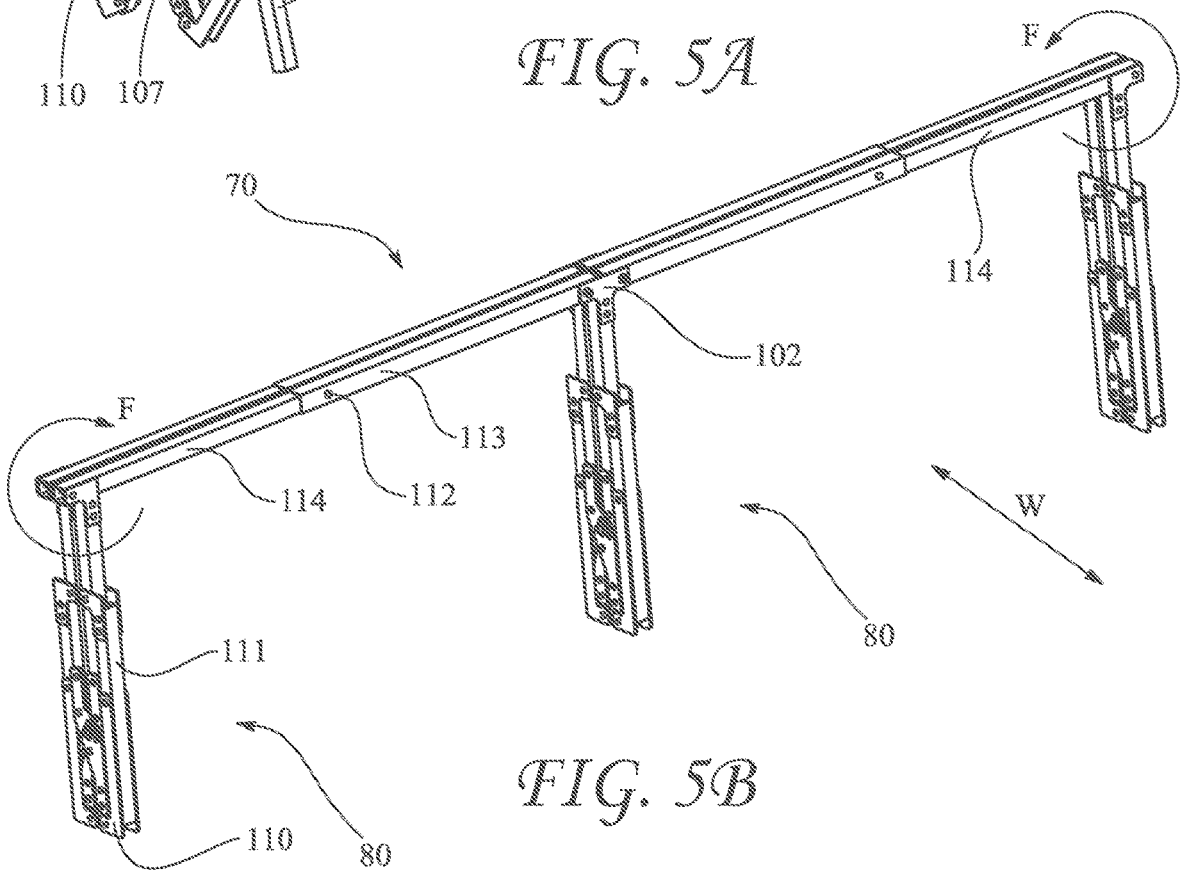
FIG. 5B is an isometric view of the cot assembly of FIG. 2 completely collapsed about the width thereof and with the outer leg assemblies ready to be folded upwards.
Figure 5C:
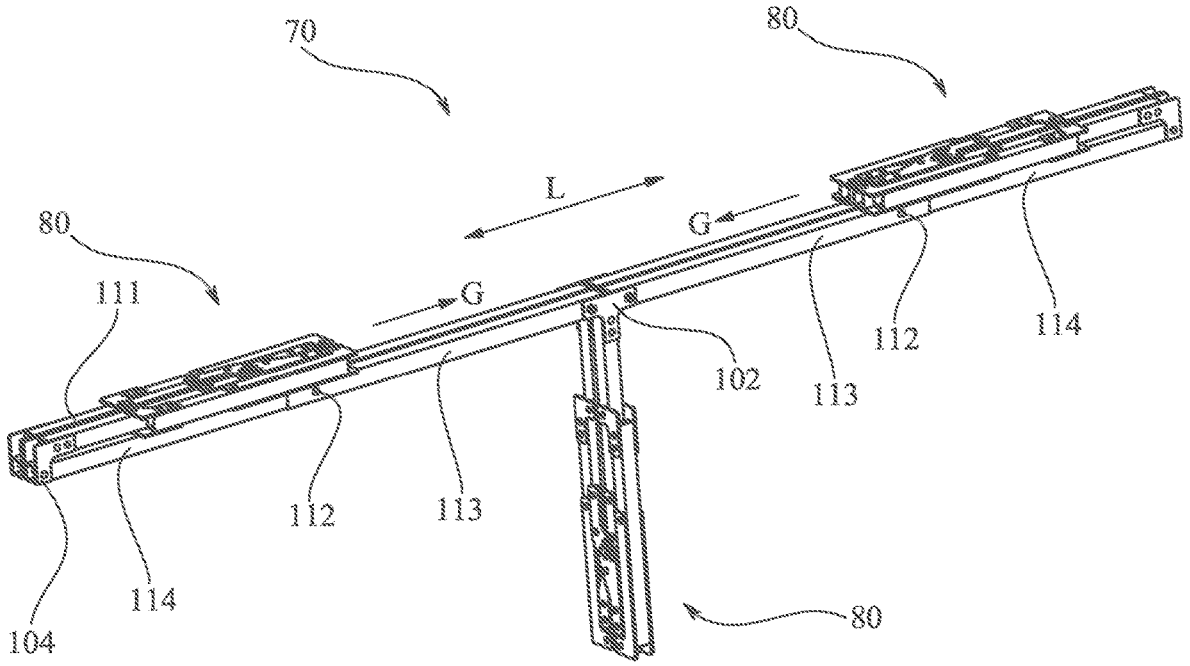
FIG. 5C is an isometric view of the cot assembly of FIG. 2 with the exterior leg assemblies folded upwards and ready to be telescoped inwards.
Figure 5D:
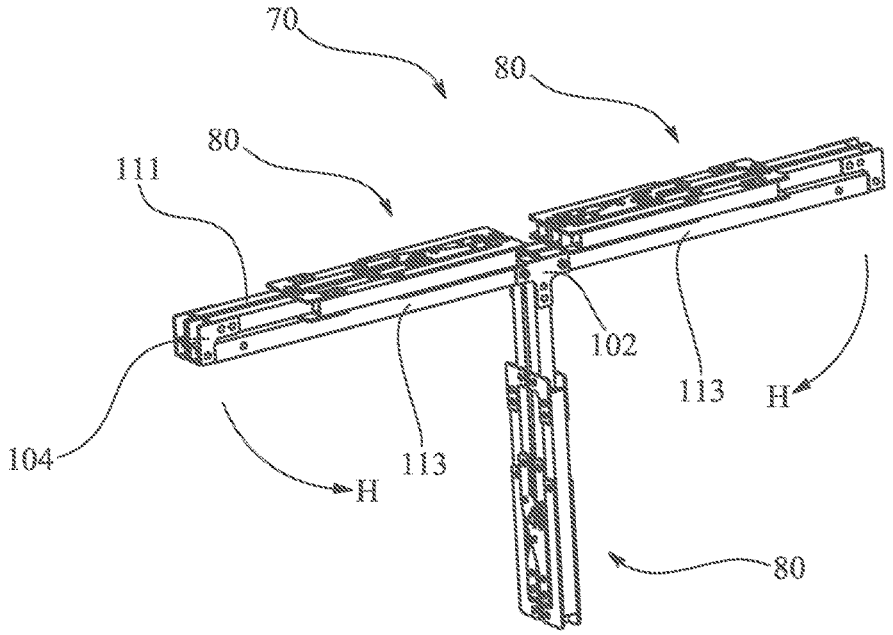
FIG. 5D is an isometric view of the cot assembly of FIG. 2 with the outer leg assemblies telescoped inwards about a length of the cot and ready to be folded down on the center leg assembly.
Figure 5E:
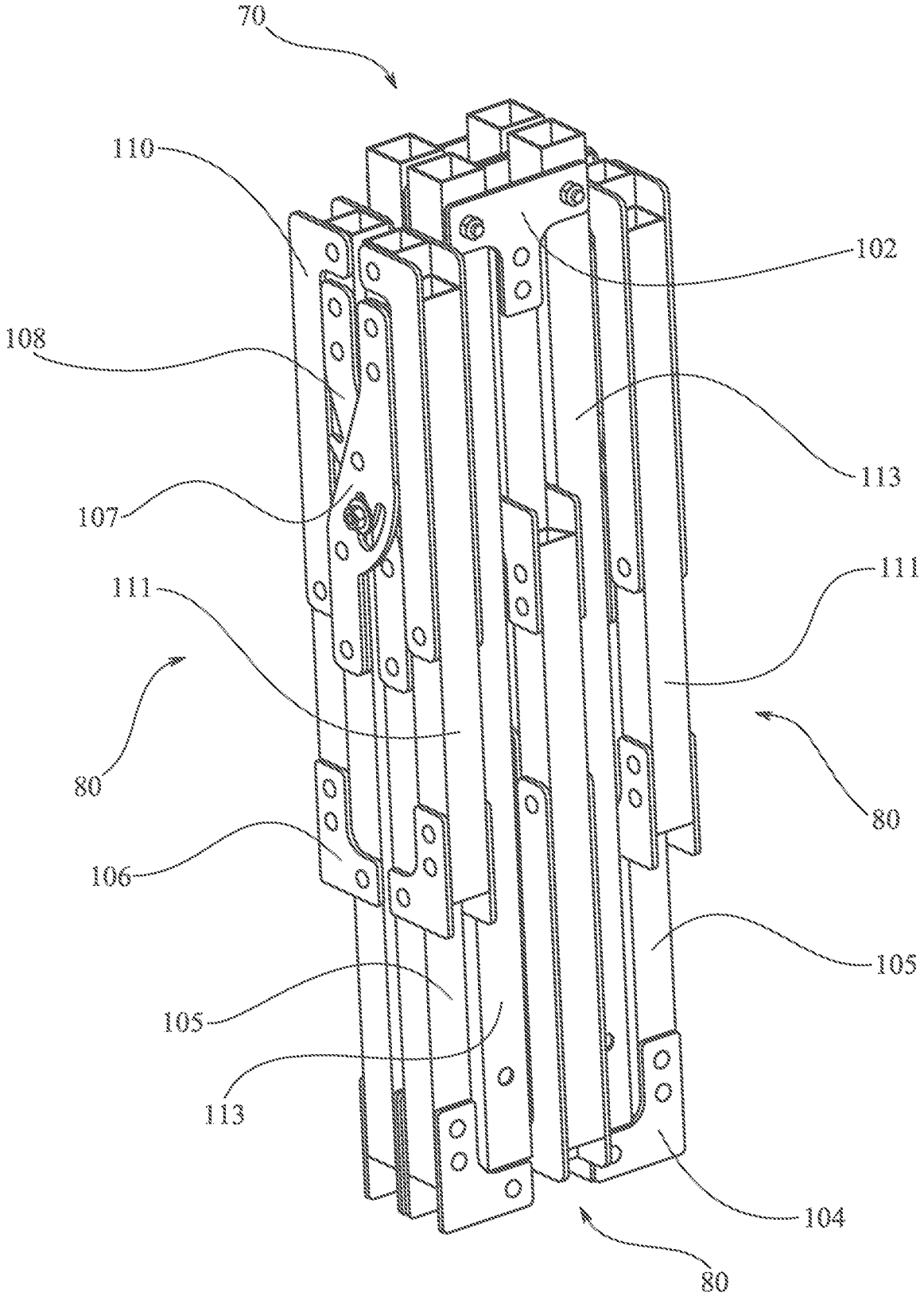
FIG. 5E is an isometric view of the cot assembly of FIG. 2 in a completely collapsed and compact form.

FIG. 5A, which shows the cot in the same state as in the previous FIG. 3B and FIG. 4B, offers a view of the entire cot assembly 70 in the process of being collapsed about the width W, with the collapsing motion illustrated by the arrows E. In now looking at FIG. 5B, this depiction shows the cot assembly 70 when totally collapsed about the width W; that is, in the same state as figures FIG. 3C and FIG. 4C. Once the cot assembly 70 is totally collapsed about the width W as in FIG. 5B, the exterior leg assemblies 80 may then be pivoted about the end of the inner telescoping bed rail tubes 114 in a motion illustrated by the arrows F until the leg assemblies 80 are lying on top of and are substantially parallel to the telescoping bed rail tubes 113, 114. In now referring to FIG. 5C, the exterior leg assemblies 80 and inner telescoping bed rail tubes 114 can be collapsed about a length L of the cot assembly 70; that is, in the direction of the arrows G, by depressing the locking buttons 112 and pushing the inner telescoping bed rail tubes 114 within the outer telescoping bed rail tubes 113. The result of this action can be seen in FIG. 5D, from where, the exterior leg assemblies 80 and telescoping bed rail tubes 113, 114 can be rotated about the pivoting connections (e.g. bolted, pinned, or like connections) in the T-shaped hinge plates 102 in the motion as represented by the arrows H until the exterior leg assemblies 80 and the telescoping bed rail tubes 113, 114 are lying in a position substantially parallel to the center leg assembly 80. FIG. 5E then shows the cot assembly 70 with the exterior leg assemblies 80 and the telescoping bed rail tubes 113, 114 lying in a position substantially parallel to the center leg assembly 80, in its final folded position.

Although the present invention has been illustrated and described herein with reference to preferred embodiments and specific examples thereof, it will be readily apparent to those of ordinary skill in the art that other embodiments and examples may perform similar functions and/or achieve like results.

The invention claimed is:

1. A cot assembly comprising:

a plurality of bed rail members; and a plurality of leg assemblies each connected to the plurality of bed rail members, each of the plurality of leg assemblies comprising:

a pair of upper leg members;

a pair of lower leg members each pivotally connected to one of the upper leg members;

a cross-hinge assembly connected to the upper leg members; and a pair of extension arm members each pivotally connected to the cross-hinge assembly and to one of the lower leg members, wherein the cross-hinge assembly comprises:

a slot; and a pin configured to slide within the slot so to lock the leg assembly in a deployed position.

2. The cot assembly of claim 1, wherein the slot comprises a straight portion and a curved portion, wherein the pin is in the straight portion of the slot with the leg assembly in a deployed position, and wherein the pin is in the curved portion of the slot with the leg assembly pivoting between the deployed position and a collapsed position.

3. The cot assembly of claim 2, wherein the cross-hinge assembly comprises a pair of hooks configured to retain the pin in the straight portion of the slot in the deployed position so to lock the cot assembly in the deployed position.

4. The cot assembly of claim 2, wherein the cross-hinge assembly comprises a spring configured to pull the pin to a bottom of the straight portion of the slot.

5. The cot assembly of claim 1, wherein the plurality of leg assemblies are pivotally connected to the plurality of bed rail members.

6. The cot assembly of claim 1, wherein the plurality of bed rail members comprises telescoping bed rail members.

7. The cot assembly of claim 6, further comprising a button for collapsing the telescoping bed rail members.

8. The cot assembly of claim 1, wherein the plurality of leg assemblies comprises two exterior leg assemblies.

9. The cot assembly of claim 8, wherein the exterior leg assemblies are pivotable relative to the plurality of bed rail members.

10. The cot assembly of claim 9, wherein the exterior leg assemblies are connected to the plurality of bed rail members via one or more hinge plates.

11. The cot assembly of claim 1, wherein the plurality of leg assemblies comprises one interior leg assembly.

12. The cot assembly of claim 11, wherein the plurality of bed rail members are pivotable relative to the interior leg assembly.

13. The cot assembly of claim 12, wherein the interior leg assembly is connected to the plurality of bed rail members via one or more hinge plates.

14. The cot assembly of claim 1, further comprising a fabric web connected to the plurality of bed rail members.

15. The cot assembly of claim 1, wherein the cross-hinge assembly is X-shaped.

16. The cot assembly of claim 1, wherein each of the lower leg members are connected to corresponding upper leg members via one or more L-shaped hinge plates.

* * * * *